United States Patent [19]

Satake

[11] Patent Number: 4,513,867

[45] Date of Patent: Apr. 30, 1985

[54] SORTER FOR GRAINS, PULSES AND THE LIKE

[75] Inventor: Toshihiko Satake, Higashihiroshima, Japan

[73] Assignee: Satake Engineering Co., Ltd., Tokyo, Japan

[21] Appl. No.: 387,235

[22] Filed: Jun. 10, 1982

[30] Foreign Application Priority Data

Jun. 16, 1981 [JP] Japan ..... 56-93217
Sep. 19, 1981 [JP] Japan ..... 56-148018

[51] Int. Cl.[3] ..... B07C 5/34
[52] U.S. Cl. ..... 209/44.2; 209/694; 209/635
[58] Field of Search ..... 209/656, 691, 694, 635, 209/397, 44.1, 28, 700, 707, 44.2

[56] References Cited

U.S. PATENT DOCUMENTS

| | | | |
|---|---|---|---|
| 147,991 | 2/1874 | Smith | 209/28 X |
| 743,752 | 11/1903 | Read | 209/694 |
| 3,807,554 | 4/1974 | Satake | 209/694 |
| 3,933,249 | 1/1976 | Welsh et al. | 209/694 X |

FOREIGN PATENT DOCUMENTS

| | | | |
|---|---|---|---|
| 3481 | of 1875 | United Kingdom | 209/694 |

*Primary Examiner*—D. A. Scherbel
*Assistant Examiner*—Glenn Foster
*Attorney, Agent, or Firm*—Norbert P. Holler; Bert J. Lewen

[57] ABSTRACT

A sorter for grains, pulses and the like having a perforated sorting plate mounted on a frame and both longitudinally and laterally inclined with respect to the horizontal plane and adapted to be vibrated in the longitudinal direction while being intermittently lifted toward the upper side. The perforated sorting plate overlies an air chamber into which pressurized air is introduced by a blower through an air duct. The perforated sorting plate is provided with a corrugated upper surface to define a multiplicity of ribs oriented in the direction perpendicular to the direction of vibration of the sorting plate and in parallel rows at a pitch not less than the size of the material to be sorted. A set of discharge openings for receiving the sorted material is provided at the lower end of the perforated sorting plate where the ribs terminate. Auxiliary air passages communicating with the space above the sorting plate are provided to permit removal of dust and other granular material of lower specific gravity than the grains being sorted.

6 Claims, 8 Drawing Figures

SORTER FOR GRAINS, PULSES AND THE LIKE

This invention relates to an improvement of a sorter for grains, pulses and the like, and more particularly, to a sorter which is suitable for pulses and the like that have been deemed difficult to be sorted in the past because they roll very easily. The sorter of the invention has been developed in order to make the efficient sorting by fully utilizing differences in coefficient of friction, specific gravity, form and size of grains or like to be sorted, in spite of such rolling characteristic that will adversely affect the sorting.

Heretofore, there have been widely employed two types of sorters for use in sorting pulses. The first one is the so-called rolling sorter in which a belt is inclined with respect to the horizontal plane not only in the longitudinal direction but also in the lateral direction, and the belt is turned toward the upper side, while the second one is the so-called rocking sorter in which a perforated wall sorting plate through which jets of air pass and having a roughened surface is mounted at an inclination with respect to the horizontal plane, the sorting plate being adapted to be vibrated in the longitudinal direction so as to cause pulses to be moved toward the upper side and, hence, to be sorted while being rocked, and the sorted pulses are discharged in the direction perpendicular to the vibration, i.e. in the lateral direction. The former sorter is to carry out the sorting in such a manner that a mixture of the complete grains and the damaged grains, which have suffered damages done by insects, diseases, immatureness or mechanical actions, is supplied on the belt and only the complete grains roll over the belt sideward, whereas the remaining damaged grains are moved toward the upper side along the turning direction of the belt. However, when the damaged grains are once rolled they are accelerated by inertia to form the same stream as the complete grains and, then, joined with a stream of the complete grains. Thus, it has been deemed very difficult to perform the high accurate sorting by the sorter of this type. In the latter sorter, the sorting plate is vibrated in order that pulses and the like which roll very easily are moved toward the upper side while being rocked. However, since there is provided on the inclined surface no means to prevent them from slipping, the complete grains locating at the bottom of the sorting plate also slide over the roughened surface thereof serving as the perforated wall through which jets of air pass, so that such complete grains flow toward the lower side of the sorting plate and will be mixed with the damaged grains. Thus, the sorting becomes imperfect. In some of the latter sorters, several bars extending in the rocking direction are provided on the sorting plate at certain places, thereby to provide a proper flow resistance in the discharging direction. However, such sorters include no corrugated ribs arranged in parallel with each other in the direction perpendicular to the vibration of the sorting plate, which ribs are essential to prevent pulses and the like from unfavourably slipping due to the vibration. As a result, it was also impossible to perform the desired highly accurate sorting with the sort4er of this type.

This invention now provides such a sorter in which a perforated wall sorting plate is mounted on a unit frame of the sorter to be inclined both longitudinally and laterally with respect to a horizontal plane and to be vibrated in the longitudinal direction while being intermittently lifted toward the upper side thereof. The perforated wall sorting plate communicates with a blower means through an air duct. The perforated wall sorting plate is formed to have a corrugated surface comprising a multiplicity of corrugated ribs arranged in the direction perpendicular to the direction of vibration of the sorting plate and in parallel rows at a pitch not less than the size of materials to be sorted. A discharge portion for receiving the materials having been sorted is provided at the lower end of the perforated wall sorting plate where the ribs terminate.

When the materials to be sorted, such as pulses, including the damaged grains are supplied on some area of the perforated wall sorting plate arranged at the upper side thereof, the materials are spread over the sorting plate in the from of a thin layer and this grain layer is subject to lifting power due to the uniform force of air jets. The complete grains having smooth surfaces are moved toward the upper side thanks to the rocking-up action caused by the corrugated ribs while resting on the surface of the sorting plate, and at the same time they are prevented from slipping toward the lower side. Meanwhile, the damaged grains having rugged surfaces, i.e. with higher coefficient of friction, rest on the complete grains to form a layer due to large air resistance thereof and will be subject to lifting power with first priority. As a result, the damaged grains are raised up to the top surface of the grain layer and then slide over the grain layer, so that they are moved toward and collected on the lower side. In this manner, the sorting is carried out with high accuracy.

More specifically, according to the invention, the differences in coefficient of friction, specific gravity, form and size between the complete grains and the damaged grains are utilized as factors for the sorting. Also in the present invention, since the corrugated ribs are arranged in the form of parallel rows unlike the prior sorting plate which has certain short projections provided separately with each other, there is formed no area through which the complete grains can pass and flow toward the lower side. Therefore, the complete grains located on the bottom surface of the sorting plate assuredly jump the ribs and move toward the upper side. This eliminates the drawback that the complete grains may slip toward the lower side. Accordingly, only the complete grains having the smooth outer surfaces and large specific gravity are moved toward the upper side, whereas the damaged grains having the rugged surfaces or anomalous forms are slipped over the top surface and moved toward the lower side. The complete grains and the damaged grains form respective streams separated from each other, so that both the grains are collected on the upper side and the lower side, respectively. The mixed grains form another stream locating between the above two streams. These three streams flow out into the discharge portion separately. In this manner, the supplied materials are sorted in accordance with the grades.

The corrugated ribs according to the invention are not limited to those which extend in the direction perpendicular to the vibrating direction of the sorting plate. It is also possible to slightly incline the corrugated ribs with respect to the above perpendicular direction, thereby to accelerate the discharging. The sorting plate can be selected to have any angle of inclination in the discharging direction as desired.

By way of example only, certain illustrative embodiments of the invention will now be described with reference to the accompanying drawings in which.

Figure 1:
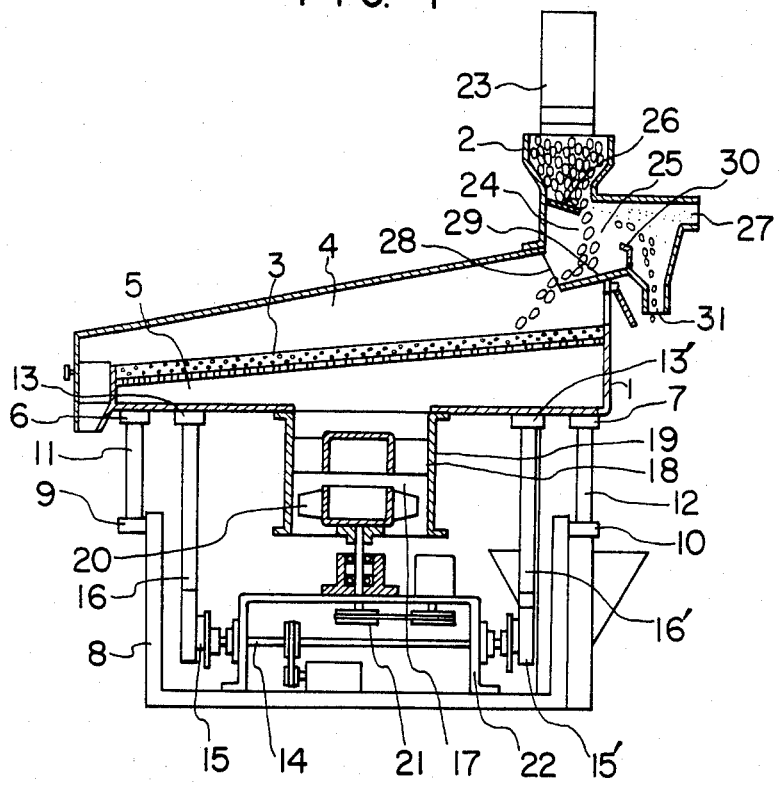
FIG. 1 is a partially sectioned side elevational view of a sorter in accordance with an embodiment of the invention.

Referring first to FIG. 1 showing a sorter in accordance with an embodiment of the invention, a supply hopper (2) is provided on one end side of a sorting frame (1) in the enclosed form and a perforated wall sorting plate (3) is arranged within the sorting frame (1) to be inclined with respect to the horizontal plane, as described later in more detail. An air exhaust chamber (4) is formed above the sorting plate (3), while an air blasting chamber (5) is formed below the sorting plate (3). The sorting frame (1) and the sorting plate (3) are constructed as a unit with each other. In order that the sorting frame (1) mounted to be inclined with respect to the horizontal plane can be vibrated in the longitudinal direction while being intermittently lifted toward the upper side, four supporting points (6), (b'), (7) and (7') (only (6), (7) are shown in FIG. 1) located at the lower surface of the sorting frame (1) near four corners thereof are connected to four lower supporting points (9), (9'), (10) and (10') (similarly only (9), (10) are shown in FIG. 1) located on a unit frame (8) of the sorter via resilient supporting rods (11), (11'), (12) and (12') (only (11), (12) are shown in FIG. 1), respectively. Thus, the sorting frame (1) is elastically supported on the unit frame (8). Force receiving points (13), (13') of the sorting frame (1) are connected to cranks (15), (15') of a vibrator (14), respectively, via rods (16), (16') extending upwardly and obliquely. Moreover, a duct tube (19) including therein fixed blades (18) of a blower means (17) is secured at the bottom of the aforesaid air blasting chamber (5), while a rotary shaft (21) of movable blades (20) fitted within the duct tube (19) is journalled to a fixed frame (22) of the vibrator (14), thereby to rotate the movable blades (20). The reference numeral (23) denotes an elevator used for elevating the materials up to the supply hopper. An outlet portion of the supply hopper (2) is enlarged to form a winnowing chamber (24). The winnowing chamber (24) includes at the center thereof a winnowing passage (25) in the laterally elongated form, and a deflecting plate (26) is provided at the outlet portion of the supply hopper (2). In addition, a foreign matter discharge port (27) is formed in the side wall of the winnowing chamber (24) in front of the deflecting plate (26), a normal grain feeding plate (29) including at the lower end thereof a normal grain discharge opening (28) which also serves as an air supply port is disposed to be inclined at the bottom of the winnowing chamber (24) below the deflecting plate (26), and a restricting plate (30) is vertically provided at the upper end of the inclined feeding plate (29) but its angle can be adjusted as desired. An immatured grain discharge port (31) is formed in front of the restricting plate (30), and the normal grain discharge opening (28) of the winnowing chamber (42) communicates with the aforesaid air exhaust chamber (4) in the sorting frame (1).

Figure 2:
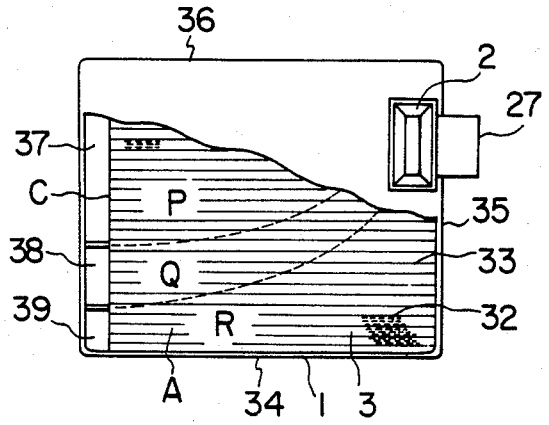
FIG. 2 is a plan view of the sorter shown in FIG. 1, with a part of a sorting frame being broken away.

FIG. 2 shows the perforated wall sorting plate (3) which is formed of a perforated wall plate including a great number of through holes (32) and a multiplicity of corrugated ribs (33), and hence which has a corrugated surface (A). The sorting plate (3) is opened at one end side thereof in the lengthwise direction of the corrugated ribs so as to form a discharge opening (C), whereas three side walls (34), (35) and (36) are vertically provided at the remaining three side edges, respectively, and these side walls (34), (35) and (36) are connected to the adjacent one, thereby to form the unitary sorting frame (1). When a mixture of the complete grains and the damaged grains is supplied on the sorting plate (3) from the supply hopper (2) provided near one corner of the sorting frame (1), the supplied grains are separated into several streams flowing toward the upper side or the lower side while moving on the sorting plate (3) in the lateral direction. Thus separated grains are discharged into a complete grain discharge opening (37), a mixed grain discharge opening (38) and a damaged grain discharge opening (39), respectively, which are formed in the discharge opening (C) at the end of the sorting plate (3).

In FIG. 1, the perforated wall sorting plate (3) is disposed to be inclined with respect to the horizontal plane in such a manner that the upper side thereof is supported by the side wall (36) shown in FIG. 2 and the lower side thereof is supported by the side wall (34) along the longitudinal direction. In addition to the above, the sorting plate (3) is disposed within the sorting frame (1) to be inclined also in the lateral direction as shown in FIG. 1 in such a manner that the upper side thereof is supported by the side wall (35) shown in FIG. 2. Namely, the perforated wall sorting plate (3) is disposed within the sorting frame (1) to be inclined in both the longitudinal and lateral directions in such a manner that the corner connecting between the side wall (35) and the side wall (36) in FIG. 2 located at the highest level, whereas the portion adjacent to the damaged grain discharge opening (39) is located at the lowest level. By means of the rods (16), (16') and the cranks (15), (15') of the vibrator, the sorting frame (1) and hence the perforated wall sorting plate (3) are longitudinally vibrated while being intermittently lifted toward the upper side in the longitudinal direction. Thus, when the materials to be sorted are supplied on the sorting plate (3) from the hopper (2) which is located at a position near the highest corner of the sorting plate (3), they will be subject to the rocking-up action in the longitudinal direction.

With the arrangement as mentioned above, when a mixture of the complete grains and the damaged grains is fed into the supply hopper (2) and then the sorter is actuated to start its operation, an air flow generated by the blower means (17) is jetted into the air exhaust chamber (4) from the air blasting chamber (5) through the perforated wall sorting plate (3). The exhaust air flows into the winnowing passage (25) in the winnowing chamber (24) through the normal grain discharge opening (28) and carries out the winnowing action of the mixed grains which fall down from the supply hopper (2). More specifically, the foreign matters of light weight are discharged out of the sorter from the foreign matter discharge port (27), the immatured grains with small specific gravity are flown far in the distance and then discharged out of the sorter from the immatured grain discharge port (31), and the normal grains (other than the foreign matters and the immatured grains of light weight) flow down and are supplied on the sorting plate (3) within the enclosed sorting frame (1). The normal grains supplied on the perforated wall sorting plate (3) within the sorting frame (1) flow down over the slanting corrugated surface (A) in the form of a thin grain layer. Due to the action of air jets passing through the perforated wall, the damaged grains with small specific gravity are raised up to the top surface of the grain layer, but to the contrary the complete grains with large specific gravity are gathered on the bottom of the grain layer. The complete grains on the bottom of the grain layer flow in the lateral direction while being rocked up toward the upper side in the longitudinal direction under the longitudinal vibration of the sorting plate (3) acting on the plural corrugated ribs (33), thereby to form a complete grain stream (P). The damaged grains raised up to the top surface of the grain layer flow in the lateral direction while being slipped over the upper surface of the complete grains toward the lower side in the longitudinal direction, thereby to form a damaged grain stream (R). Between the two streams (P) and (R), there is further formed a mixed grain stream (Q) including both the complete grains and the damaged grains. The grains having been sorted into those three streams (P), (Q) and (R) are moved to the discharge opening (C) at the end of the sorting plate (3) and, then, flow into the complete grain discharge opening (37), the mixed grain discharge opening (38) and the damaged grain discharge opening (39) formed in the discharge opening (C), respectively. Thereafter, they are discharged out of the sorter separately.

Figure 4:
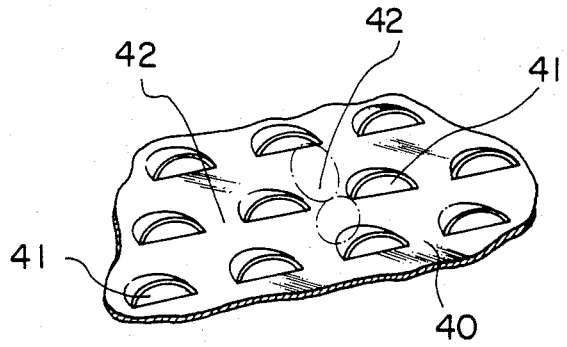
FIG. 4 PRIOR ART
FIG. 4 is an enlarged perspective view showing a part of a perforated wall sorting plate in the prior art.

As shown in FIG. 4, a perforated wall sorting plate (40) of the prior sorter mainly used for grains is so constructed that air jet holes (41) in the form of a projection for jetting air upwardly and obliquely are arranged to form a multiplicity of parallel rows with a suitable space therebetween, and the air jet holes on the odd-numbered rows and on the even-numbered rows are disposed in the staggered relationship. Therefore, plural complete grains and damaged grains are mixed and interposed to form a grain mass on the strip-like plate surface (42) in front of each air jet hole (41). This entails the drawback that the air jets passing through the air jet holes (41) can not assuredly raise up the damaged grains with small specific gravity.

Figure 3:
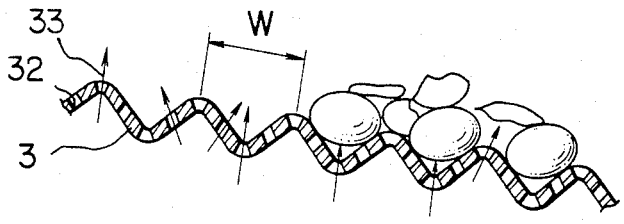
FIG. 3 is an enlarged sectional view showing a part of a perforated wall sorting plate.

To the contrary, in the sorter according to the present invention represented by FIGS. 1 to 3 there is employed the perforated wall sorting plate which is formed of the perforated wall plate including a great number of through holes (32) and a multiplicity of corrugated ribs (33) and hence which has the corrugated surface, and the pitch (W) or space between the ribs (33) is selected to be not less than a grain size, so that the complete grains with large specific gravity, which gather on the bottom of the grain layer due to the action of air jets through the perforated wall, are fitted in grooves formed between the respective ribs (33), whereas the through holes locating at the top of each rib (33) will remain in the open state. The damaged grains with small specific gravity raised up by the action of air jets rest on the complete grains or over the adjacent complete grains, so that those damaged grains locating in the top surface of the grain layer are easily and vigorously lifted up by the air jets passing through the through holes at the top of the ribs and, then, slide over the grain layer toward the lower side, thereby to form the damaged grain stream. Meanwhile, the complete grains fitted in the aforesaid grooves are assuredly rocked up toward the upper side due to the longitudinal vibration of the corrugated surface of the sorting plate while being intermittently lifted toward the upper side, thereby to form the complete grain stream. Consequently, the sorting performance will be improved positively and the sorting efficiency will be increased significantly.

Figure 5:
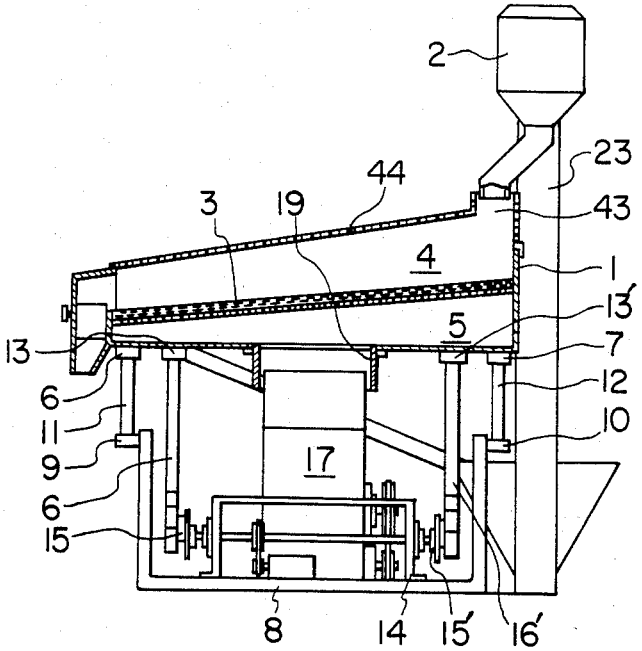
FIG. 5 is a partially sectioned side elevational view of a sorter in accordance with another embodiment of the invention.

FIGS. 5 to 8 illustrate a second embodiment of the invention. A sorter shown in FIG. 5 is similar to that in accordance with the foregoing embodiment as shown in FIG. 1 except for the following three points. The first point is that the winnowing chamber provided below the supply hopper (2) in the embodiment of FIG. 1 is dispensed with and, hence, the grains to be sorted are directly supplied on the perforated wall sorting plate (3) from the hopper (2) through a supply opening (43). The second point is that the top of the sorting frame (1) is covered with a perforated wall (44) and air is exhausted through perforations formed in the wall (44). The third point is that the perforated wall sorting plate (3) has a further improved construction. The description about the remaining similar parts will not be repeated here.

Figure 6:
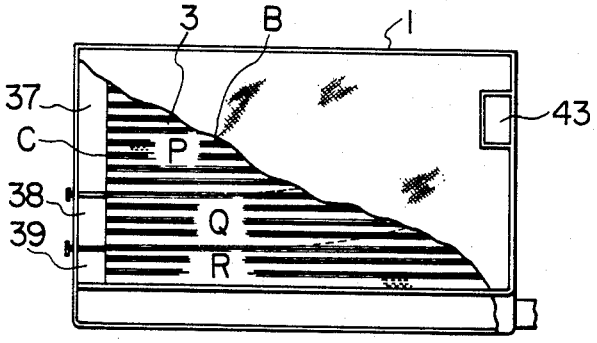
FIG. 6 is a plan view of the sorter shown in FIG. 5, with a part of a sorting frame being broken away.
Figure 7:
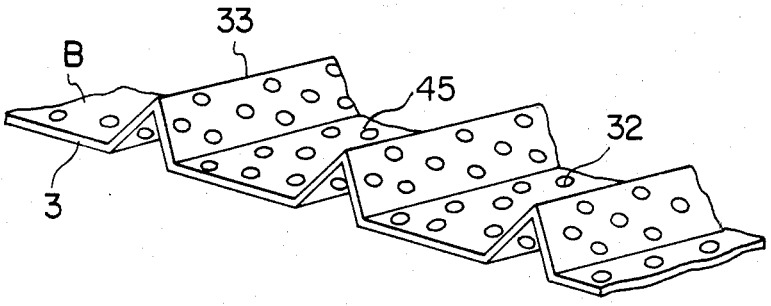
FIG. 7 is an enlarged perspective view showing a part of a perforated wall sorting plate.
Figure 8:
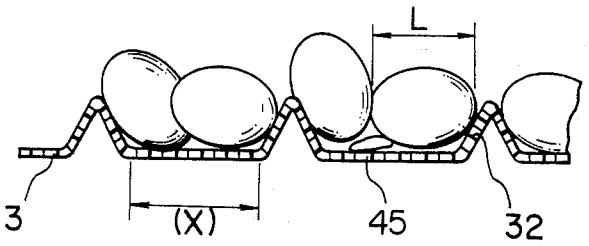
FIG. 8 is an enlarged sectional view showing a part of the perforated wall sorting plate shown in FIG. 7.

A corrugated surface (B) of the perforated wall sorting plate (3) shown in FIG. 6 includes a multiplicity of parallel corrugated ribs (33), a multiplicity of parallel elongated grooves (45) formed between each adjacent ribs, and a great number of through holes (32), as will be seen from an enlarged perspective view of FIG. 7.

As shown in FIG. 3, the perforated wall sorting plate (3) used in the foregoing embodiment of FIG. 1 has been constructed such that a multiplicity of corrugated ribs (33) are arranged in the form of saw teeth in cross-section and V-shaped grooves are formed between those ribs. Therefore, in many cases, the damaged grains or large dusts mixed with the complete grains are apt to be fitted in the V-shaped grooves and immobilized between the adjacent ribs with a part of such grain or dust being inserted into the through hole (32), so that the bottom surface of the grooves is raised up. Since the sorting plate (3) is disposed to be inclined to some degree, the complete grains which are easy to roll may get over the tops of the ribs (33) from thus shallowed bottoms of the grooves and may roll on the sorting plate toward the lower side thereof. Thus, the sorting accuracy tends to be lowered slightly. In view of the above, the perforated wall sorting plate (3) is further improved in the second embodiment. As will be seen from FIG. 8, there are provided a multiplicity of parallel corrugated ribs (33) and parallel elongated grooves (45) so as to form the corrugated surface (B), and each elongated groove (45) is formed to have a flat bottom surface of a width (X) slightly greater than a length (L) of the complete grains. Accordingly, each groove is enlarged in its width relative to that of the grooves in the first embodiment, so that the force of the air jets passing through the perforations of the bottom wall of the sorting plate is increased. This makes it possible to eliminate the aforesaid unfavorable phenomenon that the damaged grains and large dusts may be held and immobilized between the adjacent ribs. Furthermore, by increasing the vibration force of the perforated wall sorting plate (3), there can be obtained still another effect that each two complete grains fitted in the elongated groove (45) as viewed in the cross-section are rocked up at one time and, hence, the sorting efficiency is increased significantly.

What is claimed is:

1. A sorter for granular material such as cereals, pulses and the like, the granular material comprising a mixture including complete grains each having a smooth outer configuration and liable to roll and damaged grains each having an irregular outer configuration, and said complete grains having a specific gravity higher than that of said damaged grains, said sorter comprising:

a movable frame;

a perforated sorting plate having a plurality of apertures therein and mounted on said frame for movement therewith and so as to be inclined longitudinally and laterally with respect to a horizontal plane in such a manner that said perforated sorting plate has a lower discharge end, an upper end, an upper side edge and an opposite lower side edge, said perforated sorting plate cooperating with said frame to define an air chamber below said perforated sorting plate, said apertures in said perforated sorting plate being in communication with said air chamber, said perforated sorting plate being corrugated so as to have a plurality of ridges having their respective ridgelines extending in generally parallel relation from said lower discharge end of said perforated sorting plate to said upper end thereof, said ridgelines being spaced from each other a distance at least equal to a size of each of said complete grains;

means drivingly connected to said frame for vibrating the same and therewith said perforated sorting plate;

means for supplying the mixture of complete grains and damaged grains onto an area of said perforated sorting plate adjacent to said upper end thereof, the inclination of said perforated sorting plate and the orientation of said ridgelines enabling the mixture of grains to flow down along said perforated sorting plate toward said lower discharge end thereof;

means disposed at said lower discharge end of said perforated sorting plate for receiving said grains; and means for delivering pressurized air into said air chamber to cause the pressurized air to flow from said air chamber to a space above said perforated sorting plate through said apertures in the latter;

whereby, upon admission of pressurized air into said air chamber by said delivering means and upon vibration of said perforated sorting plate by said vibrating means, (a) said complete grains of the mixture supplied onto said perforated sorting plate are positively deflected toward said upper side edge of said sorting plate by said ridges on said sorting plate, and (b) said damaged grains of the mixture supplied onto said perforated sorting plate are, because of their high air resistance, subjected to upward force by the air flow through said apertures in said sorting plate, are floated up to a location further above the surface of said sorting plate than that of said complete grains, and are deflected toward said lower side edge of said sorting plate because of the higher specific gravity of said complete grains.

2. A sorter as claimed in claim 1, wherein said ridgelines extend substantially perpendicularly to said lower discharge end of said perforated sorting plate.

3. A sorter as claimed in claim 1 or 2, wherein each two adjacent ridges define therebetween a groove having an elongated planar bottom surface the width of which is greater than the maximum size of each of said complete grains.

4. A sorter as claimed in claim 3, further comprising a cover fixedly mounted on said frame and cooperating with the same to define a second air chamber above said perforated sorting plate, the pressurized air delivered into the first-mentioned air chamber by said delivering means passing into said second air chamber through said apertures in said perforated sorting plate.

5. A sorter as claimed in claim 4, wherein said cover is perforated.

6. A sorter as claimed in claim 4, wherein said means for supplying the mixture of grains comprises a hopper having an outlet port, said sorter further comprising means defining a first passage allowing said outlet port of said hopper to communicate with said second air chamber for directing the mixture of grains from said hopper into said second air chamber, and means defining a second passage in communication with said first passage at a location downstream of said outlet port of said hopper with respect to the flow of the mixture from said hopper to said second air chamber through said first passage, so that the pressurized air introduced into said second air chamber from the first-mentioned air chamber through said apertures in said perforated sorting plate allows granular material and dust having relatively low specific gravity with respect to said grains to be discharged out of said first passage into said second passage.

* * * * *